United States Patent [19]

Fallas

[11] Patent Number: 4,640,220

[45] Date of Patent: Feb. 3, 1987

[54] PAINT BOOTH ASSEMBLY

[75] Inventor: Spyros Fallas, Brighton Le Sands, Australia

[73] Assignee: Electropainting Sales Pty. Ltd., New South Wales, Australia

[21] Appl. No.: 774,054

[22] Filed: Sep. 9, 1985

[51] Int. Cl.[4] ..... B05B 15/12

[52] U.S. Cl. ..... 118/326; 118/DIG. 7; 98/115.2

[58] Field of Search ..... 118/326, DIG. 7, 632, 118/634; 98/115.2; 55/DIG. 46

[56] References Cited

U.S. PATENT DOCUMENTS 2,930,345 3/1960 Jacobsen et al. ..... 118/326 X 3,029,776 4/1962 Proskauer ..... 118/326 X

*Primary Examiner*—Shrive P. Beck

*Attorney, Agent, or Firm*—Merchant, Gould, Smith, Edell, Welter & Schmidt

[57] ABSTRACT

A spray booth assembly, having a plurality of spray chambers being rotatable about an axis, said chambers containing spray heads and sealing sleeves, and being in communication with duct means and blower means causing an air stream to pass through each chamber.

4 Claims, 4 Drawing Figures

PAINT BOOTH ASSEMBLY

The present invention relates to spray booth assemblies for the automatic painting of articles.

Conventionally spray booths, have consisted of a stationary chamber to which articles to be painted are delivered. Such an arrangement has the disadvantage that if different colours of types of paint are to be employed, then considerable time is spent in preparing the chamber for the next paint or colour.

It is the object of the present invention to overcome or substantially ameliorate the above disadvantage.

There is disclosed herein a spray booth assembly having a vertically extending housing with a generally vertically extending peripheral surface defining a plurality of vertically extending spray chambers, said chambers being angularly spaced about a generally vertical axis, and means rotatably supporting said housing for rotation about said axis.

A preferred form of the present invention will now be described by way of example with reference to the accompanying drawings wherein.

Figure 1:
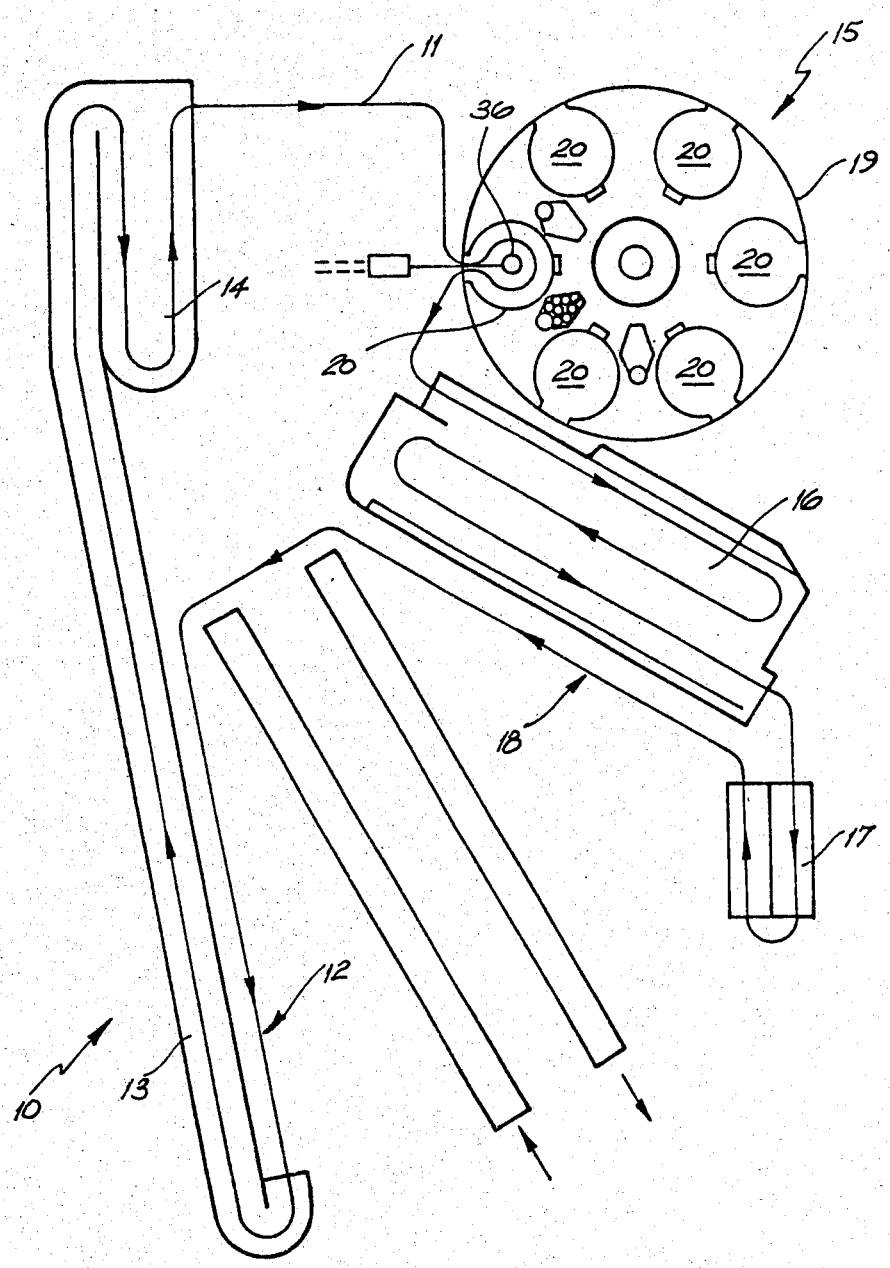
FIG. 1 is a schematic plan view of a production line to paint articles.

In FIG. 1 there is schematically depicted a production line 10 to paint articles. The production line 10 includes a conveyor system 11 which delivers the articles to various work stations. The first work station includes a loading station 12 at which articles are placed on the conveyor system 11. From there the articles are delivered via the conveyor system 11 to a pre-treatment plant 13. From the pre-treatment plant 13 the articles are delivered to a dry off chamber 14 and then to a paint booth assembly 15 where the articles are painted. Upon leaving the assembly 15, the articles are delivered to a curing oven 16 and then to a cooling station 17. The articles are then removed from the conveyor system 11 at the off-loading station 18.

Figure 2:
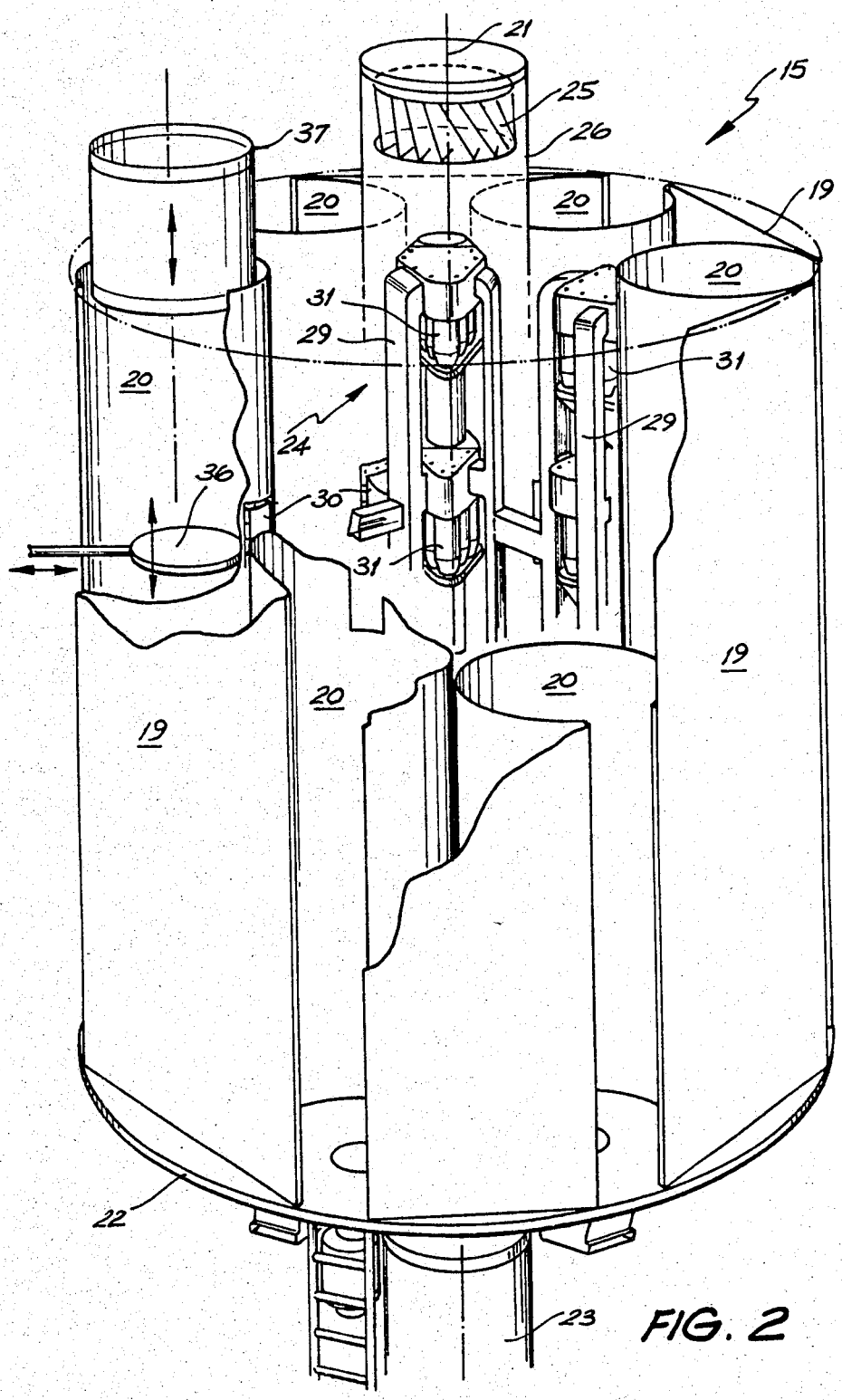
FIG. 2 is a schematic perspective view of a paint booth assembly employed in the production line of FIG. 1.
Figure 3:
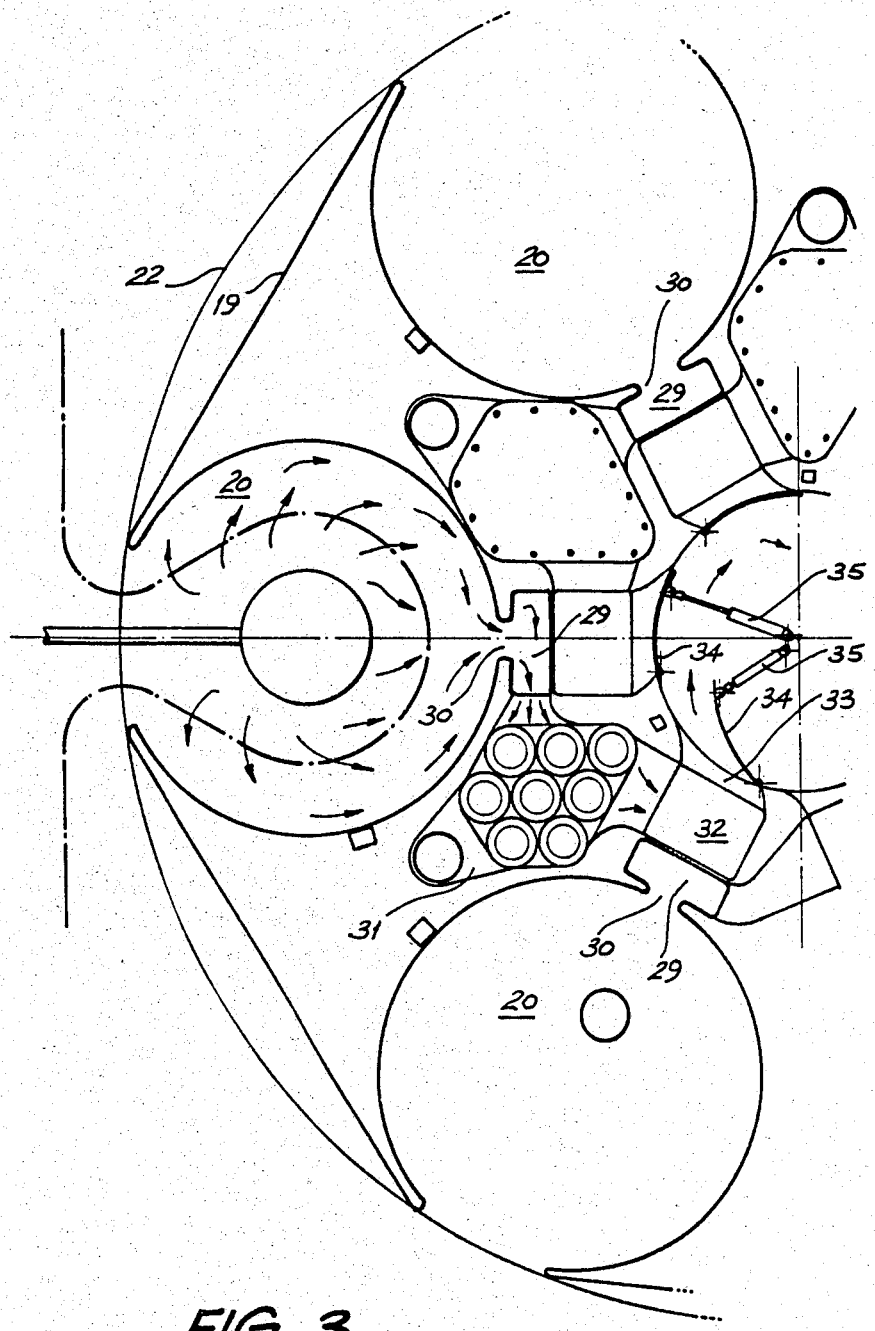
FIG. 3 is a schematic plan view of a portion of the booth assembly of FIG. 2.
Figure 4:
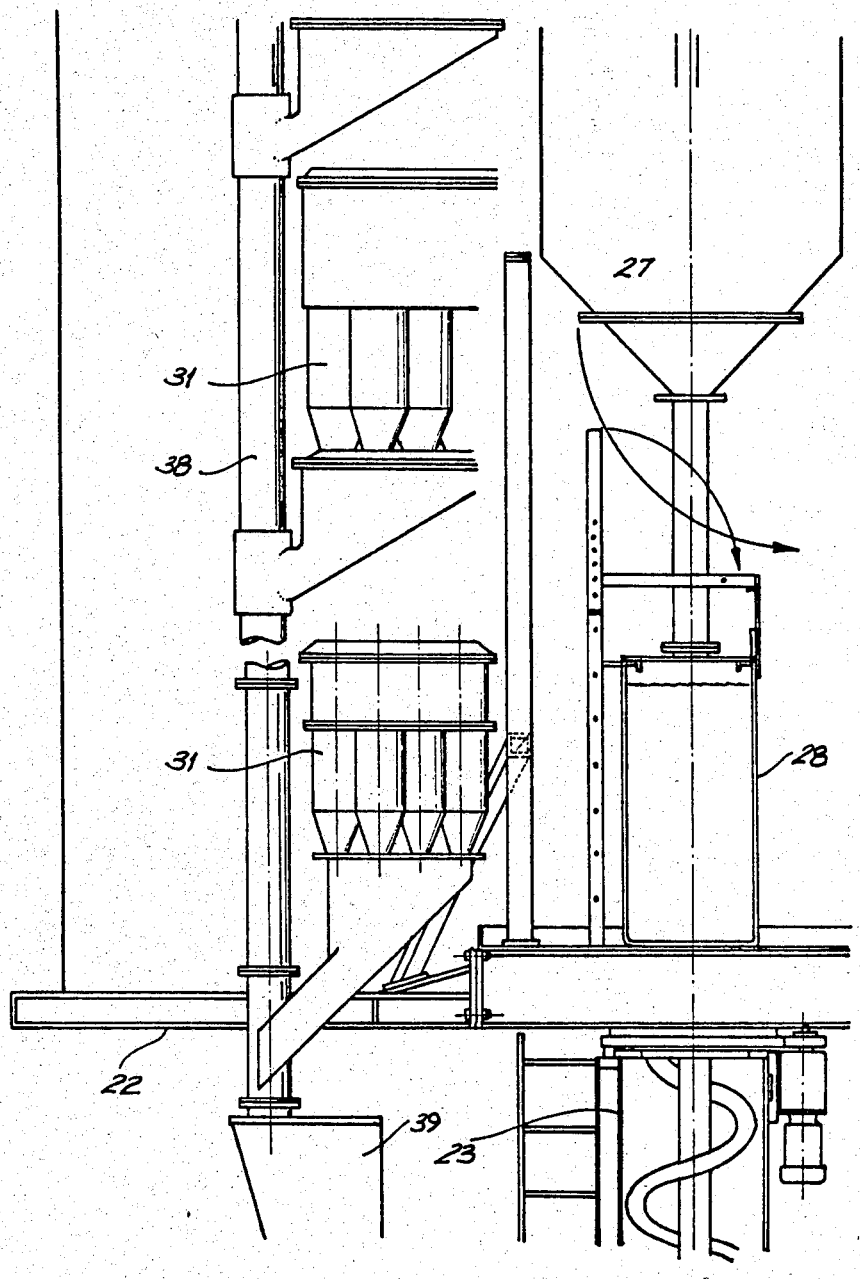
FIG. 4 is a schematic part sectioned side elevation of the booth assembly of FIG. 2.

In FIGS. 2, 3 and 4, the paint booth assembly is depicted in more detail. The booth assembly 15 has an outer housing 19 which defines a plurality of spray chambers 20 of generally cylindrical configuration. The housing 19 also defines a generally cylindrical configuration with the central axis 21 vertically oriented. The spray chambers 20 are equally angularly spaced about the axis 21. The housing 19 is mounted on a base 22 which in turn is rotatably supported by a pedestal 23. Accordingly, the housing 19 is rotatable about the axis 21.

Also mounted on the base 22 is a ventilation assembly 24 including a stand 25 mounted in a conduit 26. The conduit 26 communicates with a "fog scrubber" 27 which uses water mist to extract paint from air being drawn to the duct 26 by the fan 25 wherefrom the air is exhausted to atmosphere. The lower end of the scrubber 27 communicates with a storage tank 28 wherefrom the water may be periodically or continuously drained. Communicating with each spray chamber 20 is a primary duct 29 by means of several vertically spaced apertures 30. Each primary duct 29 communicates with an associated cyclone cleaner 31 wherefrom the majority of the paint may be extracted from the air being drawn from the chamber 20. Each cyclone 21 then communicates with a secondary duct 32. It should be appreciated that there are several cyclones 31 which can be vertically spaced adjacent the associated chamber 20. Each primary duct is provided with a closable aperture 33 which allows selective communication of particular secondary ducts 32 with the interior of the scrubber 27. Each aperture 33 is provided with a door 34 operated by a pneumatic ram 35.

Accordingly, in operation of the abovedescribed booth assembly 15, the particular chamber being employed, is connected to the fan 25 by opening the appropriate door 30 and allowing a vacuum to be applied to the appropriate secondary duct 32. Accordingly, air would be then drawn from the associated chamber 20 via the primary duct 29, and cyclone 31.

Located adjacent the booth assembly 15 are one or more spray heads 36 which are vertically reciprocated to paint articles located in the chamber 20 by the conveyor system 11. Additionally, the spray heads 36 are movable in a direction radially relative to the axis 21 so as to be withdrawn from the chamber 20.

Located above the housing 19 is a plurality of sealing sleeves 37 which are vertically movable from a first position located basically above the chambers 20, to a position telescopically located within the chambers 20. Each chamber 20 is provided with an associated sealing sleeve 37. Located above the booth assembly 15 would be a roof assembly which would basically close off the top of the sleeve 37 when in the extended position as depicted in FIG. 2.

Each of the cyclones 31 communicates with a vertically extending duct 38 which delivers collected paint to a holding tank 39.

The spray heads 36 may employ wet paint or alternatively may be powder discs which employ electrostatic depositing of the paint on the articles.

In operation of the abovedescribed booth assembly 15, each chamber 20 may be provided with a different colour paint and/or paint material (wet or powder). When an article is to be painted, it is delivered to a chamber facing the spray heads 36. Thereafter the spray heads 36 are located in the chamber 20 and the sleeve 37 extended so as to sealingly close off the upper end of the chamber 20. The paint is then applied to the article whereafter they are then delivered to the remainder of the production line 10. However, if a different colour paint or paint material is to be employed, the spray heads 36 are withdrawn from the within the chamber 20, and the sleeves 37 telescopically located within the chamber 20 whereafter the housing 19 is rotated to thereby locate the desired chamber 20 adjacent the spray heads 36. The spray heads 36 are then prepared and inserted into the newly located chamber 20 whereat the elements are then delivered. However, before painting proceeds, the sleeve 37 is again extended so as to sealingly close off the top of the appropriate chamber 20.

What I claim is:

1. A spray booth assembly having a vertically extending housing with a generally vertically extending peripheral surface defining a plurality of vertically extending spray chambers, said chambers being angularly spaced about a generally vertical axis, and means rotatably supporting said housing for rotation about said axis, each of said chambers opening radially outwardly relative to said axis.

2. The assembly of claim 1, further including duct means extending from each chamber and communicating with means to cause an air stream to pass therethrough from each chamber.

3. The assembly of claim 2 wherein said duct means extends horizontally radially inwardly from each duct and selectively communicates with a central exhaust passage, and said assembly further includes a door movable between a first position closing the duct communicating with a selected one of said vertical chambers and a second position allowing communication between the selected duct and said central exhaust passage, with said selected vertical chamber being positioned to enable a spray head to move vertically therethrough.

4. The assembly of claim 1, further including a sleeve telescopically located within each chamber and movable vertically in order to sealingly close its associated chamber.

* * * * *